United States Patent [19]

Trimble

[11] Patent Number: 4,794,832

[45] Date of Patent: Jan. 3, 1989

[54] METHOD AND APPARATUS FOR CUTTING AND UNBONDING ELASTIC BANDS

[75] Inventor: Don K. Trimble, Orinda, Calif.

[73] Assignee: Rubber Band Technology, Ltd., Yakima, Wash.

[21] Appl. No.: 180,213

[22] Filed: Apr. 11, 1988

[51] Int. Cl.[4] ..... B26D 7/06; B26D 7/27

[52] U.S. Cl. ..... 83/23; 83/54; 83/153; 83/157; 83/241; 83/694; 83/828; 83/925 EB; 83/926 H

[58] Field of Search ..... 83/23, 28, 54, 81, 109, 83/151, 153, 154, 241, 282, 614, 821, 824, 828, 679, 694, 700, 925 EB, 926 H

[56] References Cited

U.S. PATENT DOCUMENTS 3,968,710 7/1976 Gros ..... 83/23
4,060,015 11/1977 Gros ..... 83/54 X
4,579,027 4/1986 Lewis ..... 83/28

*Primary Examiner*—E. R. Kazenske

*Assistant Examiner*—Hien H. Phan

*Attorney, Agent, or Firm*—Flehr, Hohbach, Test, Albritton & Herbert

[57] ABSTRACT

An apparatus and method for cutting tubular band stock to produce an elastic band and unbonding the abutting edges of the band is disclosed. The apparatus includes a guillotine-type movable blade which cuts transversely across the tubular stock and band engaging surface proximate the blade which is formed to engage the cut band and shift opposite sides of the stock in a direction along the cut to break any bonds formed during the cutting process. The shifting apparatus is provided by a pair of fingers which engage one side of the band and cooperate with an arcuate surface engaging the opposite side of the band to shift two portions of the band next to the ends thereof toward the middle of the band and thereby effect breaking of the bonds. A reversible blade and reversible shear plate, as well as a lubricating structure and assembly for adjusting the band with which is cut also are disclosed.

22 Claims, 3 Drawing Sheets

METHOD AND APPARATUS FOR CUTTING AND UNBONDING ELASTIC BANDS

TECHNICAL FIELD

The present invention relates, in general, to the formation of elastic bands and, more particularly, relates to the cutting of elastic bands from tubular band stock and the unbonding or separating of the cut side edges of the bands after cutting.

BACKGROUND ART

One particularly effective method of forming elastic bands is to cut the same from tubular band stock with a guillotine-type of shear. Thus, the tubular band stock is held with the opposite sides in abutting relation, while a movable blade cuts down across the band stock to sever an individual band therefrom.

One of the problems which has been encountered with such band cutting apparatus is that the cutting process will cause the opposite abutting sides of the stock which are cut by the blade to bond or stick together. While the outer and inner surfaces of tubular rubber band stock is relatively cured, the interior portion of the rubber tube tends to be much less cured. When a guillotine cutter slices down across the tube, therefore, the relatively raw center portions of the opposed abutting sides of the stock sometimes bond or stick together. Unless this bonding is broken, the use of such rubber bands in automatic band-handling equipment is very difficult.

One technique for the unbonding of bands cut from tubular stock is disclosed in U.S. Pat. No. 4,579,027. Mounted proximate the movable blade is a gripping assembly that engages opposite sides of the band and then shifts the opposite sides in a direction along the cut to thereby break the bonds. More particularly, the band gripping apparatus in U.S. Pat. No. 4,579,027 includes a surface carried by the movable blade outwardly of the cutting edge and a cooperating anvil-like member that engages the opposite side of the band and moves in response to movement of the blade in order to effect shifting of the band along the cut.

While the apparatus and method of U.S. Pat. No. 4,579,027 is highly effective in breaking the bonds between cut edges of rubber bands, it is desirable to be able to simplify the apparatus further and enhance the already high efficiency and reliability of operation.

Accordingly, it is an object of the present invention to provide a method and apparatus of cutting and unbonding bonded-together opposite abutting edges of elastic bands which has improved reliability and effectiveness.

Another object of the present invention is to provide an elastic band cutting and unbonding apparatus and method which requires less maintenance, has a greater operating life, and is relatively simple to fabricate.

A still further object of the present invention is to provide an elastic band cutting and separating apparatus having improved blade life and enhanced precision of operation.

The elastic band cutting and unbonding apparatus of the present invention has other objects and features of advantage which will be apparent from or set forth in more detail in the accompanying drawing and the following description of the Best Mode of Carrying Out The Invention.

DISCLOSURE OF THE INVENTION

The elastic band cutting method of the present invention includes the steps of cutting the individual band from band stock, engaging the band after the cutting step and shifting the band engaging means to produce displacement of at least one side of the band in a direction along the cut to break the bonds between the abutting side edges of the band. The improvement in the method of the present invention comprises, briefly, during the shifting step, shifting the band engaging means to produce displacement of the band at two spaced apart locations along one side of the band in oppposite directions along the cut. Most preferably, the shifting step is accomplished by shifting one side of the band at two spaced apart locations toward each other.

The apparatus for cutting and unbonding elastic bands includes cutting means mounted for movement to cut the band from band stock, band engaging means mounted proximate the cutting means and engaging the band as it is cut with the band engaging means further formed for and displacing at least one side of the band relative to the other in a direction along the cut a sufficient distance to break any bonding between opposite abutting edges of the band. The improvement in the apparatus comprises, briefly, the band engaging means engaging the band to spaced apart locations along opposite abutting edges and displacing the band at the locations in opposite directions along the cut. Most preferably, the band engaging means is provided by a pair of movable fingers mounted to cooperate with the surface carried by the cutting blade. The cutting surface is advantageously a concave surface and the fingers are resiliently biased toward engagement with the concave surface and pivotally mounted for movement toward each other along the concave surface. The cutting blade preferably has two cutting edges and is reversibly mounted to the apparatus. Moreover, the cutting blade cooperates with a band shearing member having four shearing edges so that a selected one of the four shearing edges can be used in cooperation with a selected one of the two blade cutting edges. A structure permitting cut pieces of band to migrate from between the blade and support surface is also provided, as is a guide assembly which prevents the tube stock from hanging up in the cutter.

BEST MODE OF CARRYING OUT THE INVENTION

Figure 1:
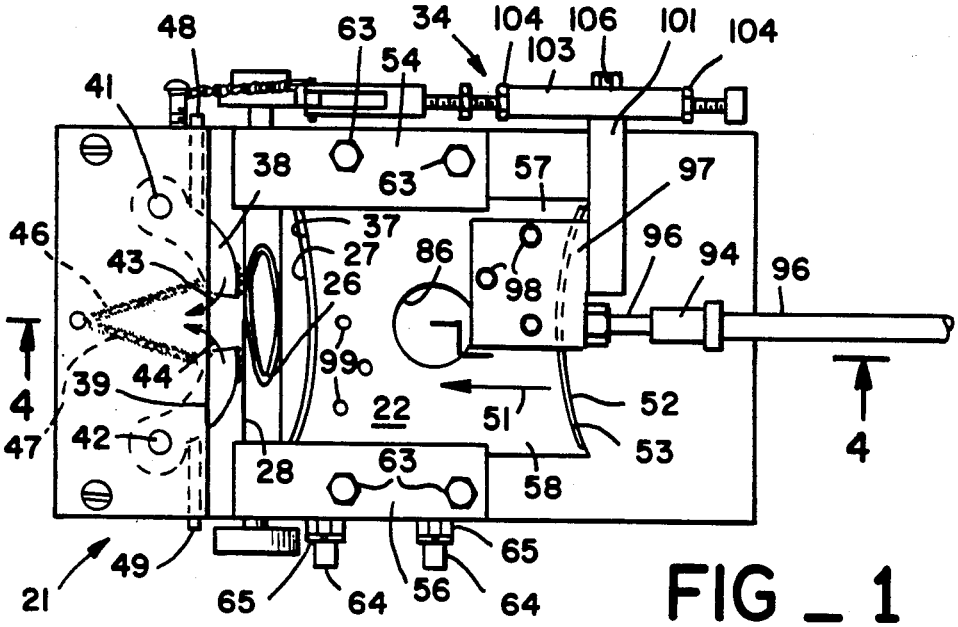
FIG. 1 is a bottom plan view of an elastic band cutting and unbonding apparatus constructed in accordance with the present invention and shown prior to cutting of a band.

The elastic band cutting apparatus of the present invention contains many components which are broadly disclosed in U.S. Pat. No. 4,579,027. Thus, apparatus 21 includes cutting means in the form of a movable blade 22 which cooperates with a stationary shearing member 23 to cut rubber bands 24 from tubular band stock 26. Blade 22 includes a cutting edge 27 which cooperates with an opposite shearing edge 28 on stationary shear member 23.

Figure 3:
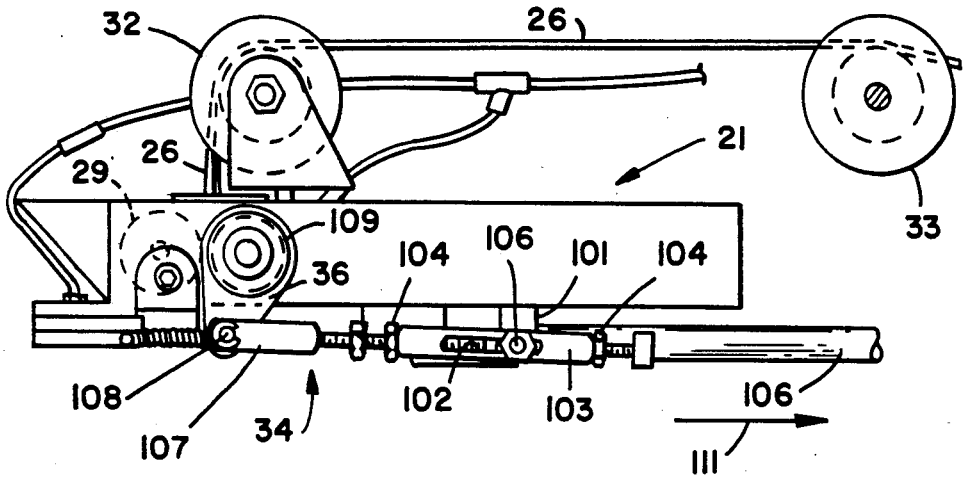
FIG. 3 is a side elevation view of the apparatus of FIG. 1.

Feeding of the band to the cutting means or assembly is accomplished by a pair of feed or draw rollers 29 and 31 which draw stock 26 over support roller 32 and a second stock supporting roller 33 (FIG. 3). The driving of raw rollers 28 and 31 is accomplished by a drive assembly, generally designated 34, which is coupled by arm 36 to drive roller 31 in a manner described in more detail hereinafter. The other draw roller 29 is mounted in a slot (not shown) and spring biased toward roller 31 to act as a follower that holds the tube stock with the opposite sides thereof in abutting relation to permit cutting by blade 22.

In order to separate the opposite abutting edges of the tube stock after band 24 has been cut from stock 26, the apparatus of the present invention further includes band engaging means mounted proximate the cutting assembly. The engaging means includes a surface 37 positioned outwardly of cutting edge 27 and carried by blade member 22. Mounted in opposed relation to surface 37 is means for engaging the opposite side of the band in cooperation with surface 37. The rubber band engaging means proximate the cutting blade in the apparatus of the present invention is mounted to displace at least one side of the cut band relative to the other in a direction along the cut by a sufficient distance to break any bonding between the opposite abutting edges of the cut band. Thus, the engaging means in the apparatus of the present invention broadly performs the same function as the band gripping means of U.S. Pat. No. 4,579,027.

Figure 2:
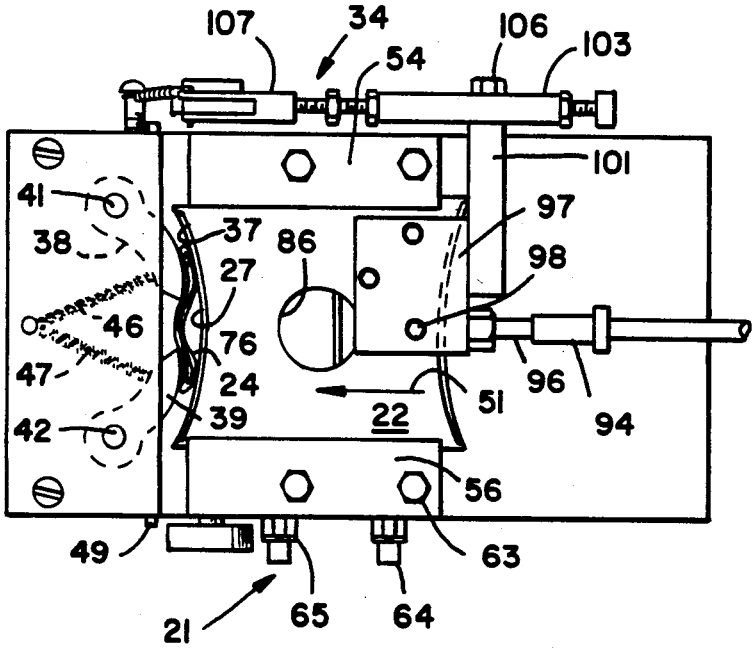
FIG. 2 is a bottom plan view corresponding to FIG. 1 and showing the apparatus after cutting and during unbonding of the band edges.

In the improved apparatus and method of the present invention, however, the band engaging means engage the band at two spaced apart locations along the band and displaces the band at the locations in opposite directions along the cut. This is most preferably accomplished by providing a pair of fingers 38 and 39 (FIGS. 1 and 2) which are pivotally mounted at 41 and 42 for movement in a direction indicated by arrows 43 and 44 against spring biasing means 46 and 47. FIGS. 38 and 39 are, therefore, biased toward blade 22, with the maximum travel in the direction of blade 22 being fixed and adjustable as a result of adjustment screws 48 and 49 (FIG. 1).

As will be seen, therefore, surface 37 engages one side of band 24, while fingers 38 and 39 engage the opposite side. As blade 22 moves in the direction of arrow 51 during cutting of the band, the fingers and surface 37 cooperate to grip the band therebetween along two portions of surface 37 and the two opposed fingers 38 and 39. Since the two portions of surface 37 which engage the bands slope toward each other or converge as the result of the surface being a concaved gripping surface, fingers 38 and 39 will pivot in reaction to the blade movement, as indicated by arrows 43 and 44. The pivoting of the fingers includes components of movement along the cut which are in opposite directions, in this case towards each other. As will be seen in FIG. 2, therefore, the end sections of the band along at least one side will be displaced toward the center of the band to cause a shifting which pinches and rolls or buckles the band toward the center and is highly effective in breaking any bonds between abutting opposite edges of the band.

While surface 37 is shown as a concave surface, it is also possible to form band engaging surface 37 and cutting edge 27 as a V-shaped converging surface having an apex at about the center of blade 22. It is believed that the use of a concaved or V-shaped cutting edge 27, which cuts against a straight cutting edge 28, also enhances band unbonding by inducing some relative shifting of band sides during the cutting process. Moreover, shifting of the rubber band along the cut by enegaging the band at two locations and moving the band in opposite but diverging directions is also possible since the elasticity of the band will permit such movement. This type of shifting also will break the bonds, but poses some problem in connection with release of the band after it has been placed under tension.

In order to increase the operating life of the blade cutting apparatus of the present invention, it is preferable to form blade 22 with two cutting edges, namely, first cutting edge 27 and an oppositely facing second cutting edge 52. Extending outwardly from second cutting edge 52 is a second band engaging surface 53. In the preferred form, the movable cutting blade 22 is formed as a plate-like member having concaved cutting edges and band engaging surfaces at opposite ends thereof.

Figure 7:
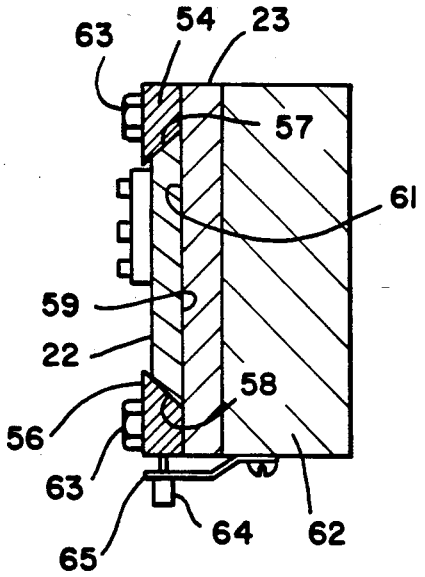
FIG. 7 is an end elevation view in cross section taken substantially along the plane of line 7—7 in FIG. 4.

As best may be seen in FIGS. 1 and 7, blade 22 is mounted for reciprocal movement to the cutting apparatus by tapered gibs 54 and 56 which mate with and trap similarly formed surfaces 57 and 58 on the edges of blade member 22. Gibs 54 and 56 guide the reciprocation of blade 22 over the support member or shear plate 23. Gibs 54 and 56 are mounted to the underlying block or frame 62 of the apparatus by fasteners 63. Moreover, in order to allow for adjustment of the blade guides to compensate for wear, gibs 56 have elongated slots which receive screws 63 and adjustment screws 64 are mounted to the sides of gib 56 so that the position of gib 56 can be adjusted laterally and then clamped in place by bolts 63. Adjustment screw 64 is threadably engaged in a tapped bore in gib 56. Bracket 65 has a U-shaped slot (not shown) which rotatably receives a neck portion of adjustment screw 64. When screw 64 is rotated, therefore, it pushes gib 56 toward or away from blade 22.

Figure 4:
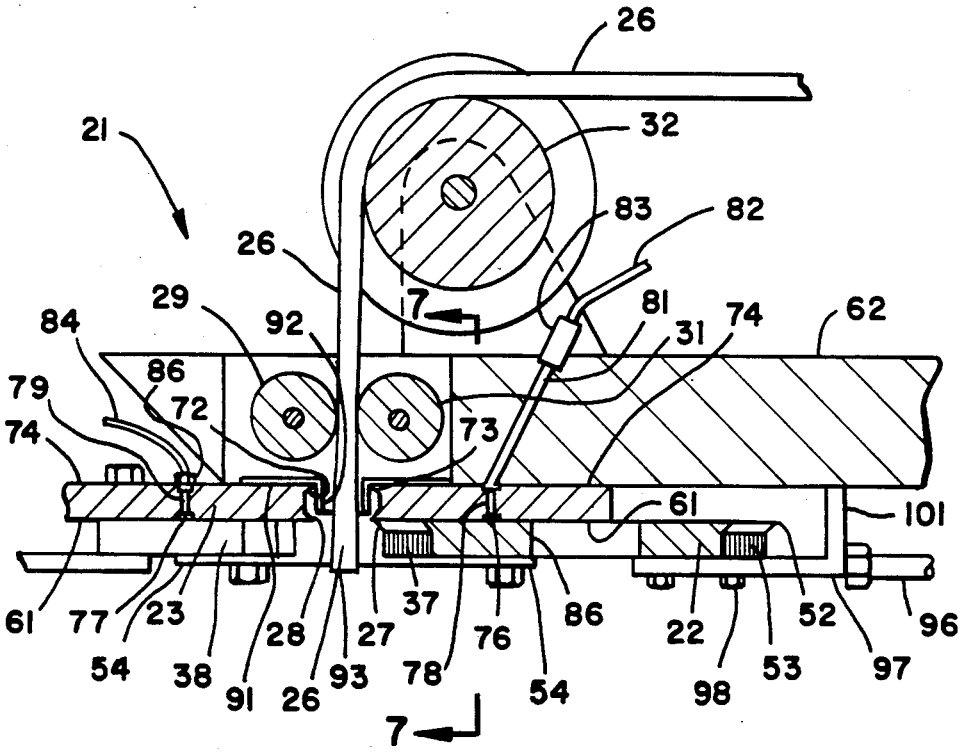
FIG. 4 is an enlarged, fragmentary, side elevation view, taken in cross section substantially along the plane of line 4—4 in FIG. 1.
Figure 5:
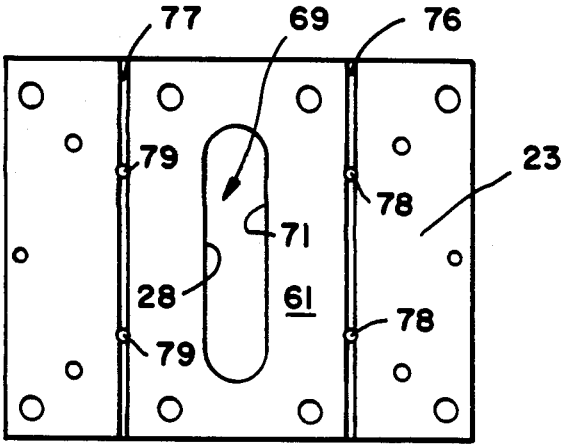
FIG. 5 is a bottom plan view of a band shearing plate employed in the apparatus of FIG. 1.

An important feature of the present invention is to provide a shear plate or member 23 which also has a long useful life. In a preferred form, member 23 is provided as a plate having an elongated slotted opening therethrough it about the midpoint of plate 23 (best seen in FIG. 5) to receive tubular stock 26 therethrough when the elastic band stock is flattened to an elongated cross section by rollers 29 and 31. The slotted opening 69 is defined by two pairs of opposed sharpened shearing edges, namely, edges 28 and 71 on face 61 and edges 72 and 73 on face 74 (FIG. 4). The shearing or support plate 23 is removably mounted to the body 62 of the apparatus so that it can be positioned so that a selected one of the cutting edges 28, 71, 72 and 73 is located for cooperation with a selected one of cutting edge 27 and 52 on blade 22 to effect cutting of the tube stock. As will be seen from FIG. 5, member 23 is generally symmetrically formed about opening 69 so that it can be reversed by 180 degrees and turned over to position any of the shearing edges for cooperation with the blade cutting edges.

It is a further important feature of the present invention to provide for lubricating means for lubrication of the movement of blade 22. Thus, support or shearing member 23 is preferably formed with transversely extending grooves 76 and 77 on face 61 of the member and a similarly formed pair of grooves on the opposite face 74 of the support member. Extending between the grooves 76 is passageway means 78, and extending between grooves 77 is a passageway means 79. Aligned with groove 76 is a further passageway 81 to which a lubrication conduit 82 is coupled by coupling means 83. A second lubrication conduit 84 is coupled by coupling means 86 to groove 77 and passageway 79. Opposed faces 61 and 74 also are both lapped and polished to a 2 micron smoothness to resist gum, tar and wax sticking on these surfaces. Thus, a light to lubricating material, such as a vegetable-based oil or a white mineral oil, can be communicated through the lubrication conduits to the grooves in the front side of plate 23. Groove 76 will communicate lubrication to the movable blade, while grooves 77 provide lubrication for movable fingers 38 and 39. The finger surfaces also are preferably lapped and polished. Such lubrication, when combined with the lapped and polished surfaces is highly effective in permitting smooth repetitive reciprocation of the cutting blade. Since all of the grooves and passageways are symmetrical with respect to member 23, remounting of the member to expose any one of the four shearing edges for cooperation with the knife blade does not interfere with the communication of lubricant to both the movable blade and the gripping fingers.

It is a further important feature of the present invention that the grooves 76 and 77 act as a means for trapping rubber particles which are sheared by the knife and migrate between the knife plate 22 and support member 23. Thus, as the movable blade reciprocates, it will invariably pull small rubber particles up between the blade and shear plate 23. Further reciprocation will tend to cause the rubber particles to move toward groove 76, at which point further migration along member 23 will stop. In the most preferred form, the movable blade is formed with an opening 86 which passes in front of groove 76, as best may be seen in FIG. 2, during part of the reciprocation cycle of blade 22. Opening 86 provides a means for the trapped rubber particles to escape from between the blade and blade support member 23. This escape is facilitated further by the discharge of lubricant into groove 76.

Figure 6:
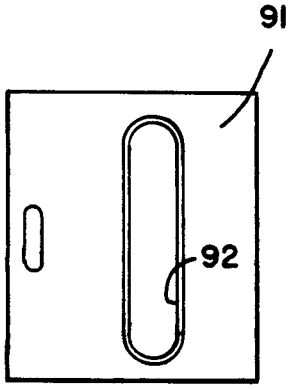
FIG. 6 is a bottom plan view of a band guiding member employed in the apparatus of FIG. 1.

In order to prevent tube stock 26 from curling down against the outermost shearing edges of shear plate 23, it is further preferable to provide the apparatus of the present invention with guide means, generally designated 91 and best seen in FIGS. 4 and 6. Guide means 91 has an elongated annular flange 92 extending from face 74 of the shear member 23 over the inner shear edges 72 and 73 to a position just short of the opposed outer shear edges 28 and 71. Guide means 91, therefore, insures that the distal end 93 of tube stock 26 cannot become hooked on either of the shear edges 28 and jam the feeding of the tube stock during the cutting process.

The length of the stroke of blade 22 can be adjusted by adjustment means 94 provided in the blade drive shaft assembly 96, which, in turn, is coupled to bracket 97 fastened by fasteners 98 to the blade. The position of the openings 99 in blade 22 permits coupling of either end of the blade to bracket 97.

In order to allow an electrical or pneumatic actuator (not shown) to drive both the blade and to advance the tube stock through tube stock drive assembly 34, a laterally extending leg 101 from bracket 97 is provided. The end of leg 101 is mounted in a slot 102 in the tube drive link 103. Adjustment of the width of the band cut by the blade is accomplished by adjusting screws 104 at each end of link 103, which control the relative position of the leg end 106 in link member 103. Extending away from link 103 is a second link member 107 which is coupled at its end through a pivotal connection 108 to arm 36 that, in turn, drives roller 31. A ratchet or clutch means 109 is used to drive the roller 31 only when blade 29 is reciprocated in a direction away from the band stock. Thus, as the blade drive shaft 106 moves in the direction of arrow 111 (FIG. 3) end 106 of the bracket leg 101 reaches the bottom or end of slot 102 and then starts to drive or pivot arm 36. This, in turn, advances the band the desired distance out beyond the shearing edge 28.

OPERATION

The method of using the band cutting and unbonding apparatus of the present invention can now be described. Band stock 26 is fed between draw rollers 29 and 31, which press the opposite sides of the band stock together for passage out through guide 91 until the tube stock extends beyond shearing edge 28. Advancement of draw roller 31 is accomplished by reciprocating the blade which drives the draw roller through assembly 34.

The first step in the method of the present invention, therefore, is cutting of an individual band from the stock while the opposed sides of stock 26 are held together by a cut across the stock with movable blade 22. Thus, cutting edge 27 of the blade passes down over cutting edge 28 of the shear member, the band stock is cut by the cooperation of the two cutting edges.

Next, the method of the present invention includes engaging the cut band 24 by band engaging means in the form of surface 37 and gripping fingers 38 and 39 which engage opposite sides of the cut band. Fingers 38 and 39 cooperate with the arcuate or concave surface 37 and the pivotal mounts 41 and 42 for the fingers to cause shifting of at least one side of the band in a direction along the edges which are cut over a distance sufficient to break any bonds between the opposite abutting edges of the band. In the improved method of the present invention, during the shifting step, the band engaging means produces displacement of the band at two spaced apart locations along the band, and the displacement is in opposite directions along the cut. Most preferably, the displacement occurs as a result of fingers 38 and 39 urging opposite ends of the band toward the center thereof to roll and buckle the band toward the center and shift the side engaged by the fingers relative to the side engaged by surface 37.

At the end of the stroke of blade 22, the band will be completely cut and any bonding produced as a result of cutting will be broken by the fingers. When blade 22 reciprocates away from the fingers, the fingers and band 24 follow the blade until the fingers reach stop means 48 and 49. At this point, the blade moves away from the fingers and the band is free to drop under the influence of gravity into a container or onto a band transferring or handling apparatus (not shown). On the reverse stroke of the blade, the band advancement assembly 34 drives draw roller 31 to advance the tube stock for cutting of a subsequent band.

The combination of two band engaging fingers which push band sections toward each other has the additional advantage of causing the cut band to assume a generally oval configuration when it drops from the cutter. Prior cutters and shifting apparatus tended to cause the band to fall away from the cutter in a somewhat flat, although unbonded configuration. The oval band shape produced by the band engaging fingers of the present invention, enhances the reliability with which bands can be dropped onto band expanding and transfer fingers for manipulation of the band.

What is claimed is:

1. A method of cutting an elastic band from tubular elastic band stock and unbonding the bonded-together opposite abutting side edges of the cut band including the steps of, cutting an individual band from said stock while opposite sides of said stock are held together by a cut across said stock with movable blade means, engaging opposite sides of said band after said cutting step with band engaging means, and shifting said band engaging means to produce displacement of at least one of said opposite sides relative to the other side in a direction along said cut over a distance sufficient to break any bonds between said opposite abutting side edges of said band, wherein the improvement in said method comprises:

during said shifting step, shifting said band engaging means to produce displacement of said band at two spaced apart locations along said band in opposite directions along said cut.

2. The method as defined in claim 1 wherein, said shifting step is accomplished by displacing said one side of said opposite sides at two locations toward each other.

3. The method as defined in claim 1 wherein, said cutting step is accomplished by employing a guillotine-type cutting blade means having a band engaging surface outwardly of the cutting edge positioned to frictionally engage said band after cutting for said shifting step, said band engaging means further including said band engaging surface, and said band engaging surface including two surface portions sloping in opposite directions with respect to each other;

said engaging step is accomplished by engaging said band by finger means on a side opposite the side engaged by said band engaging surface to cooperate with band engaging surface to grip said opposite sides of said band; and said shifting step being accomplished by shifting said finger means in opposite directions along said cut at said two surface portions as said blade means is moved to cut said band.

4. The method as defined in claim 3 wherein, said two surface portions slope in a direction facing each other, and said finger means are pivotally mounted for displacement along said cut in a direction toward each other.

5. The method as defined in claim 3 wherein, said band engaging surface is a concave arcuate surface and said cutting edge is a concave arcuate edge, and said finger means are pivotally mounted to shift spaced apart sections of said band gripped between said finger means and said surface portions toward an intermediate section of said band.

6. In apparatus for cutting an elastic band from tubular band stock and unbonding bonded opposite abutting edges of the cut band including, cutting means mounted for movement transversely across said stock to cut a band therefrom while opposite sides of said band are in abutting relation, and band engaging means mounted proximate said cutting means and engaging said band as said band is cut from said stock, said band engaging means displacing at least one side of said cut band relative to the other side in a direction along the cut by a sufficient distance to break any bonding between said opposite abutting edges resulting from cutting of said band, the improvement in said apparatus comprising:

said band engaging means engaging said band at two spaced apart locations along said band and displacing said band at said two locations in opposite directions along said cut.

7. The apparatus as defined in claim 6 wherein, said band engaging means is provided by a surface positioned outwardly of and carried by said cutting means and a pair of movable fingers mounted to cooperate with said surface to grip said band betewen said fingers and said surface.

8. The apparatus as defined in claim 7 wherein, said surface is formed with converging portions and said fingers are pivotally mounted for movement to displace a side of said band.

9. The apparatus as defined in claim 8 wherein, said surface is a concave surface; and said fingers are pivotally mounted for movement toward each other and resiliently biased into engagement with said surface.

10. The apparatus as defined in claim 6 wherein, said cutting means is provided as a movable blade, and a band shearing member, said movable blade having a first cutting edge mounted for movement relative to said band shearing member to effect cutting of said band from said tubular stock, said movable blade has a second oppositely facing cutting edge, and said movable blade being removably mounted to said apparatus for selective positioning of one of said first cutting edge and said second cutting edge for cooperation with said band shearing member to effect cutting.

11. The apparatus as defined in claim 10 wherein, said blade is formed with a band engaging surface positioned proximate and outwardly of each of said first cutting edge and said second cutting edge.

12. The apparatus as defined in claim 11 wherein, each of the band engaging surfaces is a concave arcuate surface, and each of said first cutting edge and said second cutting edge is a concave arcuate edge.

13. The apparatus as defined in claim 12 wherein, said band shearing member has a straight shearing edge.

14. The apparatus as defined in claim 10 wherein, said band shearing member includes an elongated opening therethrough having a first pair of opposed shearing edges on one face of said shearing member and a second pair of opposed shearing edges on an opposite face of said shearing member, and said shearing member is removably mounted to said apparatus for selective positioning of any one of the four shearing edges for cooperation with said blade to effect cutting of said band stock.

15. The apparatus as defined in claim 14, and guide means mounted to said support member and having flange means extending from a face opposite said blade into said slotted opening and over said pair of opposed shearing edges proximate said face opposite said blade to a position short of said pair of opposed shearing edges proximate said face slidably engaged by said blade.

16. The apparatus as defined in claim 6 wherein, said cutting means includes a stationary blade support member, and a movable blade slidably mounted to said support member, said blade support member having recess means on a face thereof in sliding contact with said blade to receive rubber band particles cut by said blade and migrating between said blade and said support member, and said blade having an opening therein positioned to periodically pass over said recess during cutting of said band to permit periodic escape of said particles from said recess through said opening.

17. The apparatus as defined in claim 16 wherein, said blade support member includes an elongated slotted opening therethrough at about a midpoint thereof dimensioned to receive said tubular stock therethrough with said opposite sides of said stock in proximity to each other, said slotted opening being defined by two pairs of opposed sharpened shearing edges on opposite faces of said blade support member, said blade support member including recess means on each side of said slotted opening on each of said opposite faces of said support member, and said support member being removably mounted to said apparatus for positioning of a selected one of said shearing edge for cooperation with said blade to effect cutting of said stock.

18. The apparatus as defined in claim 17 wherein, said support member includes recess means in the form of grooves extending transversely across each of said opposite faces of said support member on both sides of said slotted opening.

19. The apparatus as defined in claim 18 wherein, said support member includes passageway means connecting the groove in one of said faces to the groove in the other of said faces, and said support member is formed for coupling of lubrication conduit means thereto to communicate lubricant to the groove facing said blade from the opposite face of said support member.

20. The apparatus as defined in claim 6 wherein, said cutting means includes a movable blade mounted to a support surface by adjustable gib means.

21. The apparatus as defined in claim 20 wherein, said adjustable gib means includes gib members having a tapered surface mounted in sliding engagement with a tapered surface on said blade means and means for selectively moving said gib member having said tapered surface.

22. The apparatus as defined in claim 6, and means for advancing said tubular stock for cutting by said cutting means, and means for adjusting the length of advancement of said stock.

* * * * *